US010035154B2

(12) United States Patent
Hochbrueckner

(10) Patent No.: US 10,035,154 B2
(45) Date of Patent: Jul. 31, 2018

(54) DEVICE, SYSTEM, AND METHOD FOR ATOMIZER NOZZLE ASSEMBLY WITH ADJUSTABLE IMPINGEMENT

(71) Applicant: Michael J. Hochbrueckner, San Diego, CA (US)

(72) Inventor: Michael J. Hochbrueckner, San Diego, CA (US)

( * ) Notice: Subject to any disclaimer, the term of this patent is extended or adjusted under 35 U.S.C. 154(b) by 227 days.

(21) Appl. No.: 14/733,733

(22) Filed: Jun. 8, 2015

(65) Prior Publication Data

US 2016/0354793 A1 Dec. 8, 2016

(51) Int. Cl.

| | |
|---|---|
| ***B05B 1/26*** | (2006.01) |
| ***B05B 7/16*** | (2006.01) |
| ***B05B 15/65*** | (2018.01) |
| ***B05B 15/652*** | (2018.01) |

(52) U.S. Cl.

CPC ..... *B05B 1/26* (2013.01); *B05B 7/164* (2013.01); *B05B 15/652* (2018.02)

(58) Field of Classification Search

CPC ..... B05B 7/1646; B05B 1/02; B05B 1/26; B05B 15/066; B05B 7/164

USPC .... 239/418, 419, 419.3, 420, 426, 433, 434, 239/543, 545, 587.5, 588, 292

See application file for complete search history.

(56) References Cited

U.S. PATENT DOCUMENTS 366,891 A * 7/1887 Sheehan ..... B05B 1/26 239/545
630,493 A * 8/1899 Dolan ..... B05B 1/26 239/434.5
756,155 A * 3/1904 Bryant ..... B05B 1/26 239/543
774,456 A * 11/1904 Smith ..... B05B 7/1495 239/420
1,696,196 A * 12/1928 Gray ..... B05B 1/26 239/125
1,752,923 A * 4/1930 Mueller ..... B05B 7/0815 239/292
1,881,345 A * 10/1932 Beatty ..... E04F 21/12 118/303
2,410,005 A * 10/1946 Bishop ..... C21D 1/08 122/4 R (Continued)

FOREIGN PATENT DOCUMENTS

EP 0755878 A1 * 1/1997 ..... B05B 1/26

*Primary Examiner* — Steven J Ganey
*Assistant Examiner* — Steven M Cernoch
(74) *Attorney, Agent, or Firm* — Olav M. Underdal; IDP Patent Services

(57) ABSTRACT

An adjustable atomizer nozzle assembly includes an assembly body; first and second side nozzle components, including compressed air tubes, liquid tubes, liquid heater, air heater, atomizer nozzles, which are mounted with an impingement angle to create a combined aerosol stream with reduced droplet size. An adjustable atomizer nozzle system includes a nozzle assembly; a mast assembly; a self-coiling line assembly, including a compressed air line, a pressurized liquid line, and a power line; a pressure tank; a compressor; a power supply; a mounting base; and wheels. A nozzle assembly can include one atomizer nozzle with a liquid heater. A method of use includes providing an adjustable atomizer nozzle system, configuring impingement for spraying, spraying a room, configuring impingement for fogging, and fogging the room.

12 Claims, 9 Drawing Sheets

Adjustable Atomizer Nozzle Assembly

(56) References Cited

U.S. PATENT DOCUMENTS 2,458,220 A * 1/1949 Striegel ..... B05B 7/0846 239/305
2,492,526 A * 12/1949 Geibig ..... B23K 7/001 239/273
2,995,173 A * 8/1961 Nawalanic ..... B05B 7/1495 118/303
3,111,272 A * 11/1963 Underdown ..... B05B 7/1495 239/319
3,219,276 A * 11/1965 Norris ..... B05B 5/03 118/315
3,399,834 A * 9/1968 Bradley ..... B29C 41/365 239/10
3,405,679 A * 10/1968 Norris ..... B05B 1/26 118/314
3,406,913 A * 10/1968 Frangos ..... B05B 1/26 222/402.1
3,788,555 A * 1/1974 Harrison ..... E04F 21/12 239/336
3,844,485 A * 10/1974 Waggoner ..... B05B 7/1495 239/420
3,986,642 A * 10/1976 Selvia ..... B67D 1/0052 222/129.1
3,994,443 A * 11/1976 Shenker ..... B05B 1/205 134/122 P
4,076,175 A * 2/1978 Bert ..... B05B 13/0214 134/199
4,415,123 A 11/1983 Ikeuchi
4,646,977 A 3/1987 Iwamura et al.
4,762,013 A * 8/1988 Peter ..... B05B 13/041 118/315
4,783,008 A 11/1988 Ikeuchi et al.
5,046,668 A 9/1991 Ikeuchi et al.
5,226,506 A * 7/1993 Link ..... B05B 7/045 184/55.1
5,249,747 A * 10/1993 Hanson ..... B05B 1/26 239/373
5,292,074 A * 3/1994 Clark ..... B05B 13/0278 134/199
5,320,283 A * 6/1994 Hollstein ..... B05B 13/0431 239/587.1
5,387,403 A 2/1995 Ikeuchi et al.
5,785,250 A * 7/1998 De Laforcade ..... B05B 1/26 222/402.1
6,343,425 B1 2/2002 Sias et al.
RE38,023 E * 3/2003 De Laforcade ..... B05B 1/26 222/402.1
6,706,243 B1 3/2004 Sias et al.
6,752,959 B2 6/2004 Smith et al.
6,780,306 B2 8/2004 Schlager et al.
6,969,487 B1 11/2005 Sias et al.
7,008,592 B2 3/2006 Sias et al.
7,219,849 B1 * 5/2007 Hedger ..... B05B 1/26 239/543
8,272,576 B2 * 9/2012 Doak ..... B05B 7/0475 239/128
8,683,790 B2 4/2014 Ranganathan et al.
8,689,545 B2 4/2014 Hirth
2006/0283985 A1 12/2006 Ikeuchi et al.
2010/0243753 A1 * 9/2010 Doak ..... B05B 7/0475 239/11
2016/0325265 A1 * 11/2016 Zhu ..... B01J 19/24

* cited by examiner

Adjustable Atomizer Nozzle Assembly

Adjustable Atomizer Nozzle Assembly

Adjustable Atomizer Nozzle System

Adjustable Atomizer Nozzle System

Method of Using an Adjustable Atomizer Nozzle System

DEVICE, SYSTEM, AND METHOD FOR ATOMIZER NOZZLE ASSEMBLY WITH ADJUSTABLE IMPINGEMENT

CROSS-REFERENCE TO RELATED APPLICATIONS

N/A

FIELD OF THE INVENTION

The present invention relates generally to the field of atomizer nozzles, and more particularly to devices and systems for adjusting the droplet size in an atomizer nozzle assembly.

BACKGROUND OF THE INVENTION

Atomizer nozzle, produce a fine spray of a liquid, in the form of an aerosol or vapor, and can be based on the Venturi effect. Atomizer nozzles can be made according to various mechanical constructions and functional mechanisms, which can include atomizer nozzles based on fluid dynamics, electrostatics, ultrasonics, centrifugal forces, etc.

Vaporous hydrogen peroxide bio-decontamination technologies are well established and have been around for years. Aerosolized hydrogen peroxide technologies have recently been emerging and are gaining acceptability. Both technologies have their strengths and weaknesses.

Aerosolized hydrogen peroxide is less penetrating while Vaporized hydrogen peroxide is slow, uses high concentration solution, is difficult to contain, and requires an enclosed space with near ideal environmental conditions.

Past technologies have proposed using nozzle assemblies with impinging nozzles, wherein nozzles spray emissions from dual nozzles intersect at an angle, in order to produce aerosols with reduced particle size. However, these designs are limited by a static construction that does not allow for adjustment of the intersecting angle, and also they do not incorporate thermal conditioning.

As such, considering the foregoing, it may be appreciated that there continues to be a need for novel and improved devices and methods for atomizing nozzles.

SUMMARY OF THE INVENTION

The foregoing needs are met, to a great extent, by the present invention, wherein in aspects of this invention, enhancements are provided to the existing model of spray nozzles to provide an adjustable impinging thermally controlled atomizer nozzle assembly and system.

In an aspect, an adjustable atomizer nozzle assembly with adjustable impingement can allow for the adjustment of droplet size, by converging to impingement two or more aerosol streams, resulting in a very fine "dry" fog, with a design that allows for adjustment of the angle of impingement. This design feature can optimize the creation of a hybrid-oxidizing environment of both vaporous and aerosolized hydrogen peroxide.

In a related aspect, an adjustable atomizer nozzle system can be designed to heat a liquid disinfectant, to increase the vapor phase concentration and dispersion qualities of the aerosol. Such an adjustable atomizer nozzle system with liquid heating can be designed, with one, two, or more nozzles.

In a related aspect, an adjustable atomizer nozzle system can be designed to heat air before atomization, to increase the vapor phase concentration and dispersion qualities of the aerosol. Such an adjustable atomizer nozzle system with air heating can be designed, with one, two, or more nozzles.

In a related aspect, the adjustable atomizer nozzle system can be used as a high-level disinfection technology.

In a related aspect, the adjustable atomizer nozzle system can be configured as a mobile, semi-permanent, or permanent delivery system configuration, as an industrial tool intended for use by professional service providers, serving as a multi-functional system that can be operated manually as a sprayer or as an automated fogger.

In a further related aspect, the adjustable atomizer nozzle system can be configured specifically as a hydrogen peroxide ($H_2O_2$) disinfectant delivery system. However, it can also be used to apply a variety of commercially available disinfectants suitable for fogging applications.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
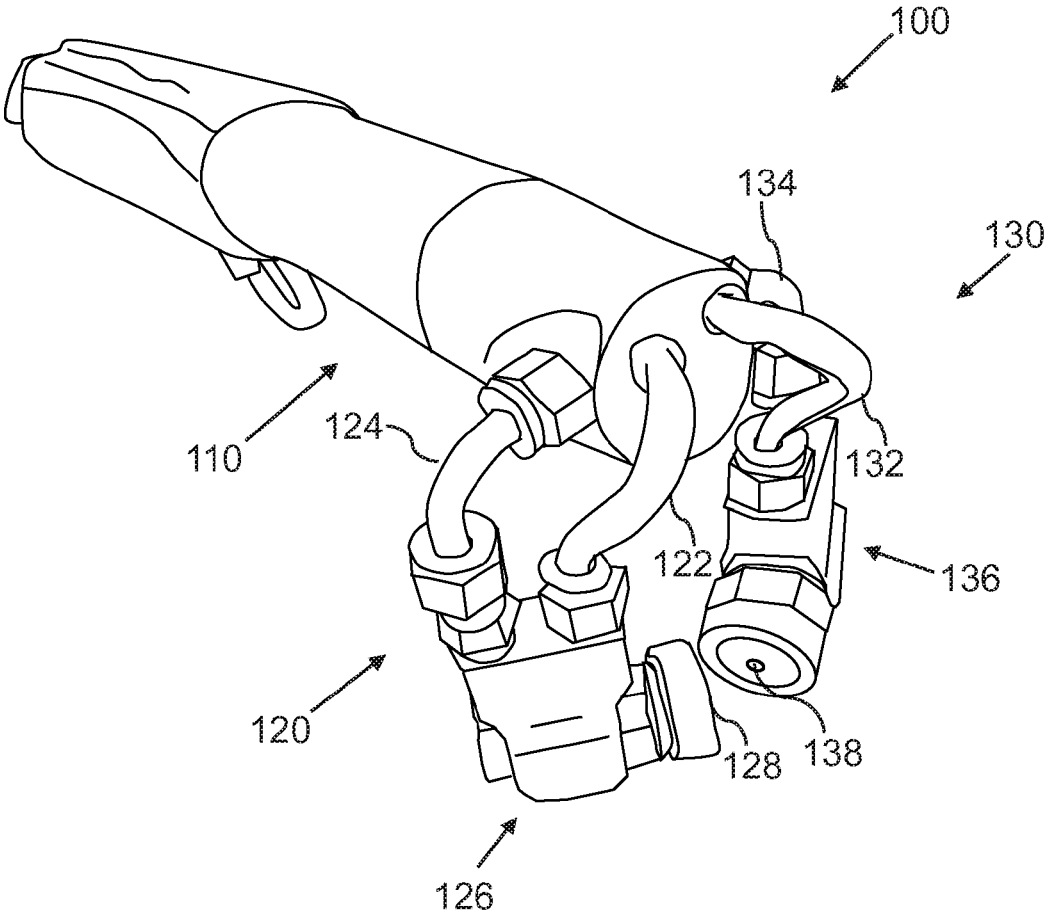
FIG. 1 is a perspective view of an adjustable atomizer nozzle assembly configured with maximum impingement angle, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of an adjustable atomizer nozzle assembly 100 with reference to FIG. 1, in such manner that like reference numerals refer to like components throughout; a convention that we shall employ for the remainder of this specification.

Figure 2:
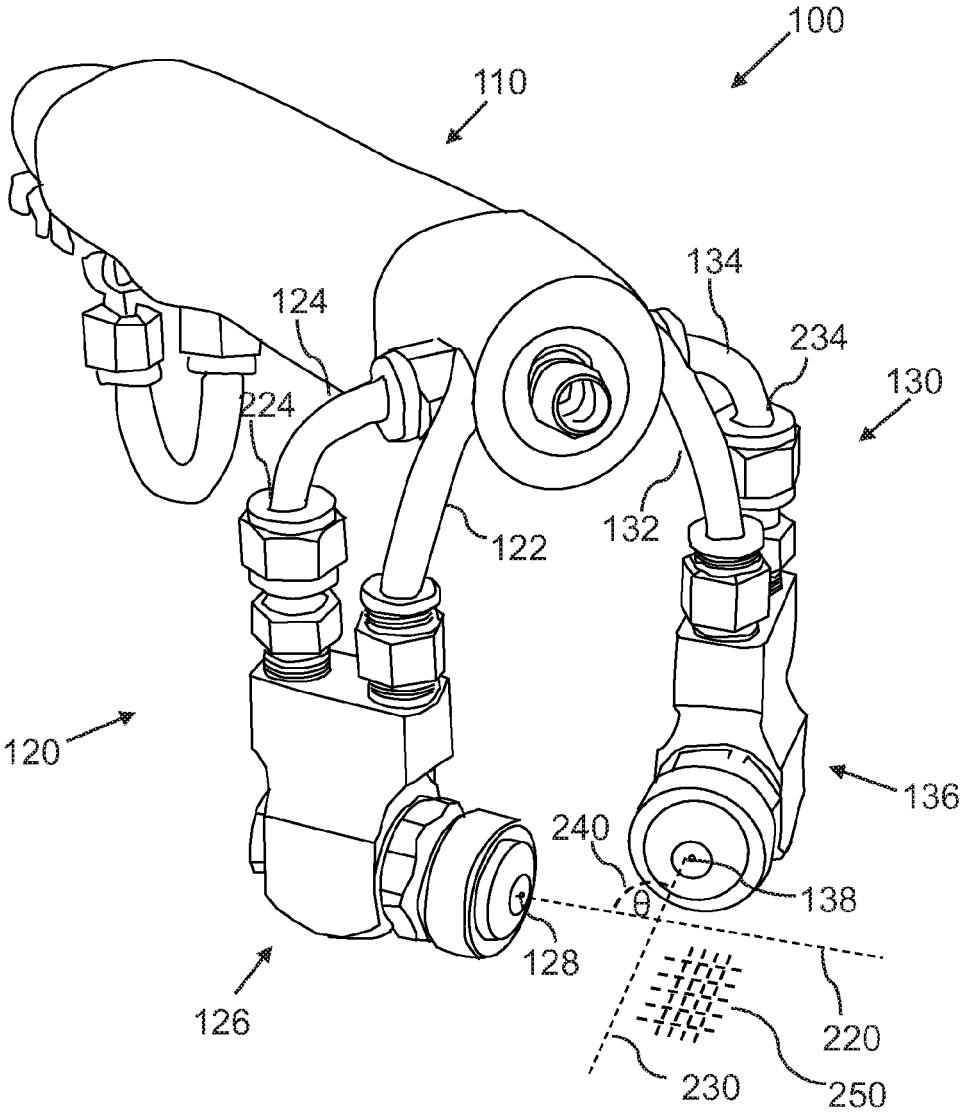
FIG. 2 is a perspective view of an adjustable atomizer nozzle assembly configured with intermediate impingement angle, according to an embodiment of the invention.
Figure 5:
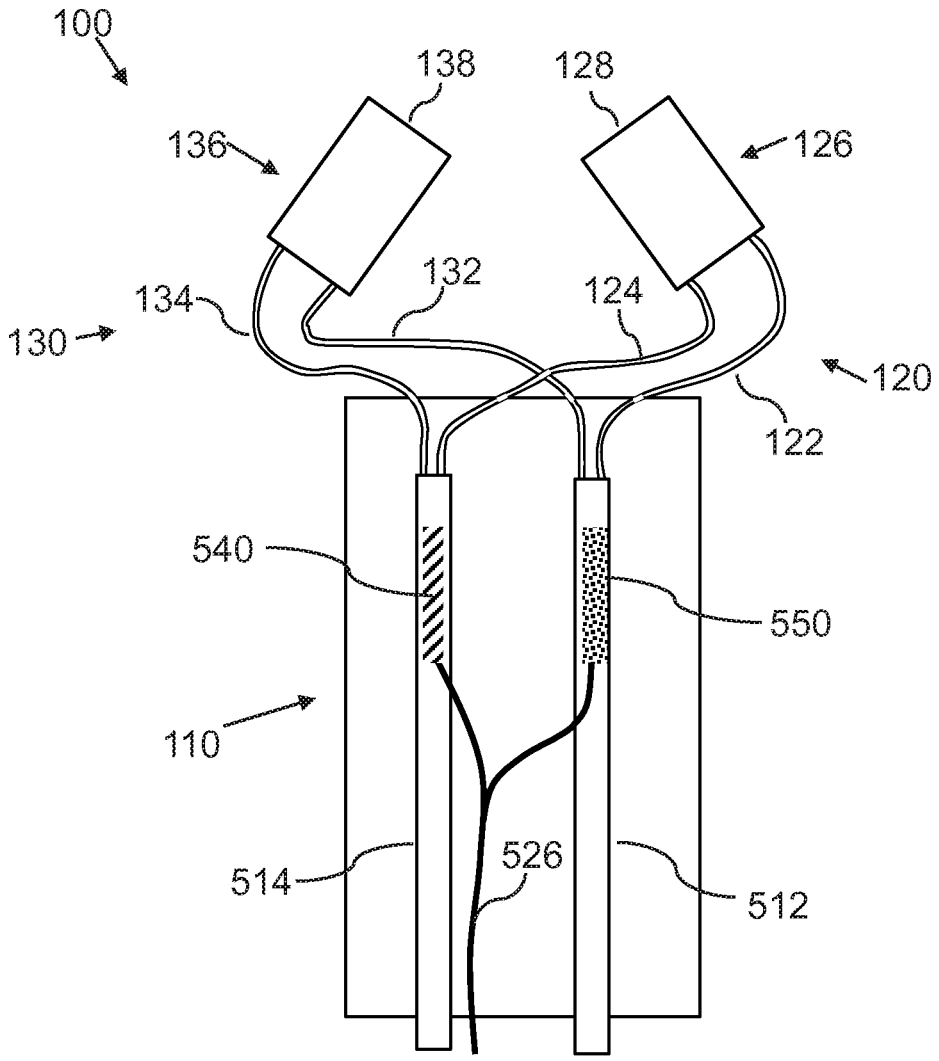
FIG. 5 is a schematic diagram of an adjustable atomizer nozzle assembly, according to an embodiment of the invention.

In an embodiment, an adjustable atomizer nozzle assembly 100 can include:

a) An assembly body 110;

b) A first side nozzle component 120, including:

i. A first compressed air tube 122;

ii. A first liquid tube 124;

iii. A first atomizer nozzle 126, which further comprises:

1. a first nozzle outlet 128;

c) A second side nozzle component 130, including:

i. A second compressed air tube 132;

ii. A second liquid tube 134;

iii. A second atomizer nozzle 136, which further comprises:

1. a second nozzle outlet 138;

wherein the first liquid tube 124 is connected in a first end to the assembly body 110, and is rotationally connected in a second end, via a first horizontal rotational connection 224, to a rear of the first atomizer nozzle 126, such that the first atomizer nozzle 126 can rotate in a horizontal plane 250, as shown in FIG. 2, which can also be referred to as a first rotation plane 250;

wherein the first compressed air tube 122 is flexibly connected between the assembly body 110 and the first atomizer nozzle 126; such that the flexible connection is enabled for example with the use of soft plastic tubing, in order to allow free rotation of the first horizontal rotational connection 224 between the first atomizer nozzle 126 and the first compressed air tube 122;

wherein the first compressed air tube 122 is in fluid connection with an internal compressed air tube 512, as shown in FIG. 5, inside the assembly body 110;

wherein the wherein the first liquid tube 124 is in fluid connection with an internal liquid tube 514, as shown in FIG. 5, inside the assembly body 110;

wherein the first atomizer nozzle 126 is configured to mix air in the first compressed air tube 122 with a liquid in the first liquid tube 124, such that the air and liquid is emitted by the nozzle outlet 128 in the form of a first aerosol stream in the direction of a first elongated axis 220, as shown in FIG. 2, from the nozzle outlet 128;

wherein the second liquid tube 134 is connected in a first end to the assembly body 110, and is rotationally connected in a second end, via a second horizontal rotational connection 234, to a rear of the second atomizer nozzle 136, such that the second atomizer nozzle 136 can rotate in a horizontal plane 250;

wherein the second compressed air tube 132 is flexibly connected between the assembly body 110 and the second atomizer nozzle 136; such that the flexible connection is enabled for example with the use of soft plastic tubing, in order to allow free rotation of the second horizontal rotational connection 234 between the second atomizer nozzle 136 and the second compressed air tube 132;

wherein the second compressed air tube 132 is in fluid connection with an internal compressed air tube 512, as shown in FIG. 5, inside the assembly body 110;

wherein the second liquid tube 124 is in fluid connection with an internal liquid tube 514, as shown in FIG. 5, inside the assembly body 110;

wherein the second atomizer nozzle 136 is configured to mix air in the second compressed air tube 132 with a liquid in the first liquid tube 134, such that the air and liquid is emitted by the second nozzle outlet 138 in the form of a second aerosol stream in the direction of a second elongated axis 230, as shown in FIG. 2, from the second nozzle outlet 138;

wherein the first and second aerosol streams intersect at an impingement angle 240, 0, between the first elongated axis 220 and the second elongated axis 230, as shown in FIG. 2;

wherein the impingement angle 240 can be adjusted by adjusting a first rotational position of the first horizontal rotational connection and a second rotational position of the second horizontal rotational connection;

whereby the first and second aerosol streams intersect and combine to form a combined aerosol stream, and whereby adjustment of the impingement angle 240 adjusts the average droplet size and distribution of the combined aerosol stream.

In a related embodiment, the liquid tubes 124, 134 and the compressed air tubes 122, 132 can be interchanged such that the compressed air is instead carried in a tube with a rotatable connection, and the liquid is carried in a flexibly connected tube.

In a related embodiment, the adjustable atomizer nozzle assembly 100 can be configured with separate rotatable connections between the assembly body 110 and the nozzles 126, 136 such that the liquid tubes 124, 134 and the compressed air tubes 122, 132 are flexibly connected tubes.

In a related embodiment, FIG. 1 illustrates a configuration of the adjustable atomizer nozzle assembly 100 with a near maximum impingement angle 240 of approximately 135 degrees. This can produce a very small average droplet size of approximately 5 micron.

In a related embodiment, FIG. 2 illustrates a configuration of the adjustable atomizer nozzle assembly 100 with an intermediate impingement angle 240 of approximately 90 degrees.

Figure 3:
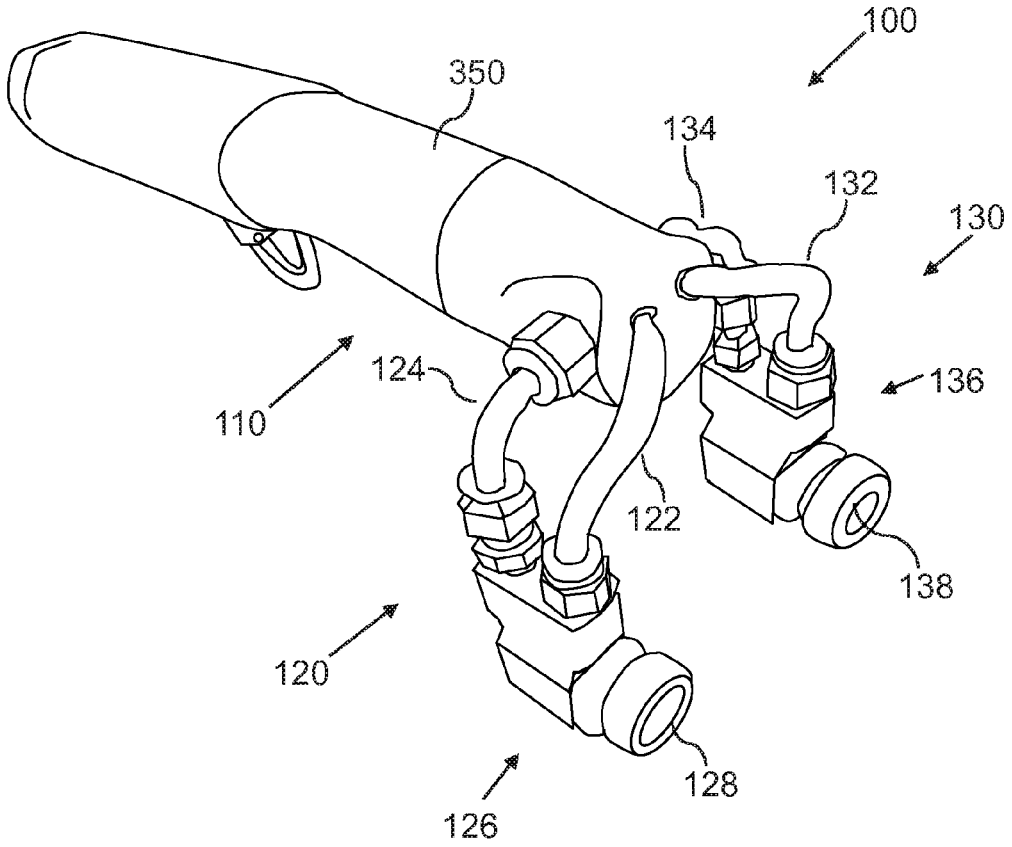
FIG. 3 is a perspective view of an adjustable atomizer nozzle assembly configured with zero impingement angle, according to an embodiment of the invention.

In a related embodiment, FIG. 3 illustrates a configuration of the adjustable atomizer nozzle assembly 100 with an impingement angle 240 of approximately zero degrees, whereby the first and second aerosol streams are approximately parallel, such that they only overlap by dispersion to the sides and do not directly intersect. This can produce an average droplet size of approximately 15 micron.

In a related embodiment, the impingement angle 240 can be negative, which indicates that the first and second aerosol streams are diverging to a right and left side, and will not intersect, such that a wider area can be covered by separated aerosol streams. A negative 90 degree impingement angle 240 provides optimal substantially non-intersecting coverage of an 180 degree span in front of the nozzle assembly 100.

In a related embodiment, a smaller droplet size can be desirable for automated fogging and a larger droplet can be desirable for manual spraying.

Figure 4:
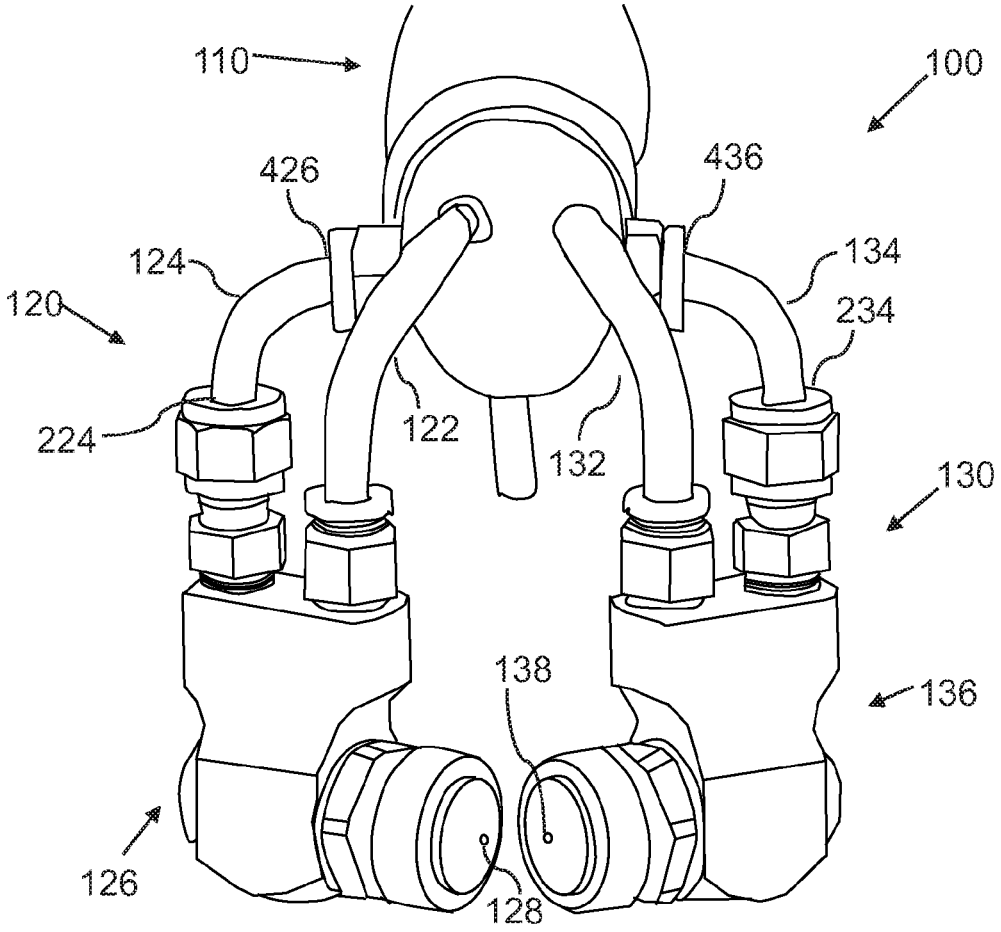
FIG. 4 is a front perspective view of an adjustable atomizer nozzle assembly configured with maximum impingement angle, according to an embodiment of the invention.

In a related embodiment, FIG. 4 illustrates a front perspective view of a configuration of the adjustable atomizer nozzle assembly 100 with a near maximum impingement angle 240 of approximately 135 degrees.

In a related embodiment, FIG. 5 illustrates a schematic diagram showing the fluid and electrical connections of the adjustable atomizer nozzle assembly 100.

In a related embodiment, as shown in FIG. 5, the adjustable atomizer nozzle assembly 100 can further include:

a. a liquid heater 540, which is configured to heat a fluid in the internal liquid tube 514, before the fluid flows to the nozzles 126, 136;

wherein the liquid heater 540 can be powered by an electrical wire 526;

whereby the heating can increase production of hydrogen peroxide vapor, cause increased penetration of porous surfaces, and enhance the dispersive qualities of the aerosol.

In a related embodiment, as shown in FIG. 5, the adjustable atomizer nozzle assembly 100 can further include:

a. An air heater 550, which is configured to heat air in the internal compressed air tube 512, before the air flows to the nozzles 126, 136;

wherein the air heater 550 can be powered by an electrical wire 526;

whereby heating of the air can avoid undesirable reduction of aerosol temperature when the adjustable atomizer nozzle assembly 100 is used in an environment with a low ambient air temperature, such as for example a surgical operating room.

In related embodiments, an aerosol stream or combined aerosol stream from the atomizer nozzle assembly 100 can be heated with a heating source mounted in the nozzle assembly, such as a plasma heater; a flame source, a high voltage arc, or infrared lamp.

In an embodiment, as shown in FIG. 3, the adjustable atomizer nozzle assembly 100 can further include:

a. a handle 350, also called a hand grip 350, which can allow a user to hold on to the adjustable atomizer nozzle assembly 100.

In an embodiment, as shown in FIG. 4, the adjustable atomizer nozzle assembly 100 can further be configured such that a. the first liquid tube 124 is vertically rotationally connected in a first end to the assembly body 110, via a first vertical rotational connection 224, such that the first atomizer nozzle 126 can rotate in a vertical plane, which can also be referred to as a second rotation plane;

b. the second liquid tube 134 is vertically rotationally connected in a first end to the assembly body 110, via a first vertical rotational connection 224, such that the first atomizer nozzle 126 can rotate in a vertical plane, which can also be referred to as a second rotation plane.

It should be noted that reference to the horizontal plane 250 and the vertical plane is relative to orientation of the adjustable atomizer nozzle assembly 100, such that the horizontal plane 250 and the vertical plane can also be referred to as respectively the first plane 250 and the second plane.

Figure 6:
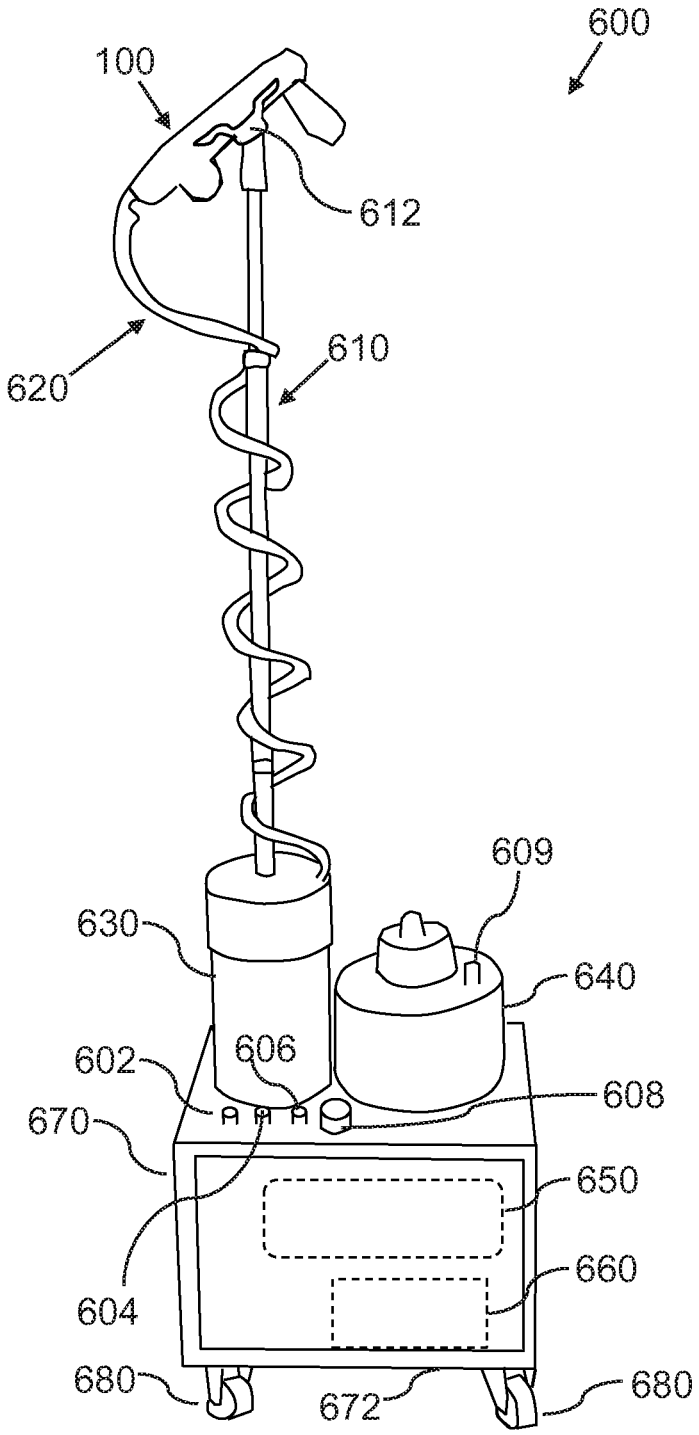
FIG. 6 is a perspective view of an adjustable atomizer nozzle system, according to an embodiment of the invention.

In an embodiment, FIG. 6 shows a perspective view of an adjustable atomizer nozzle system 600.

Figure 7:
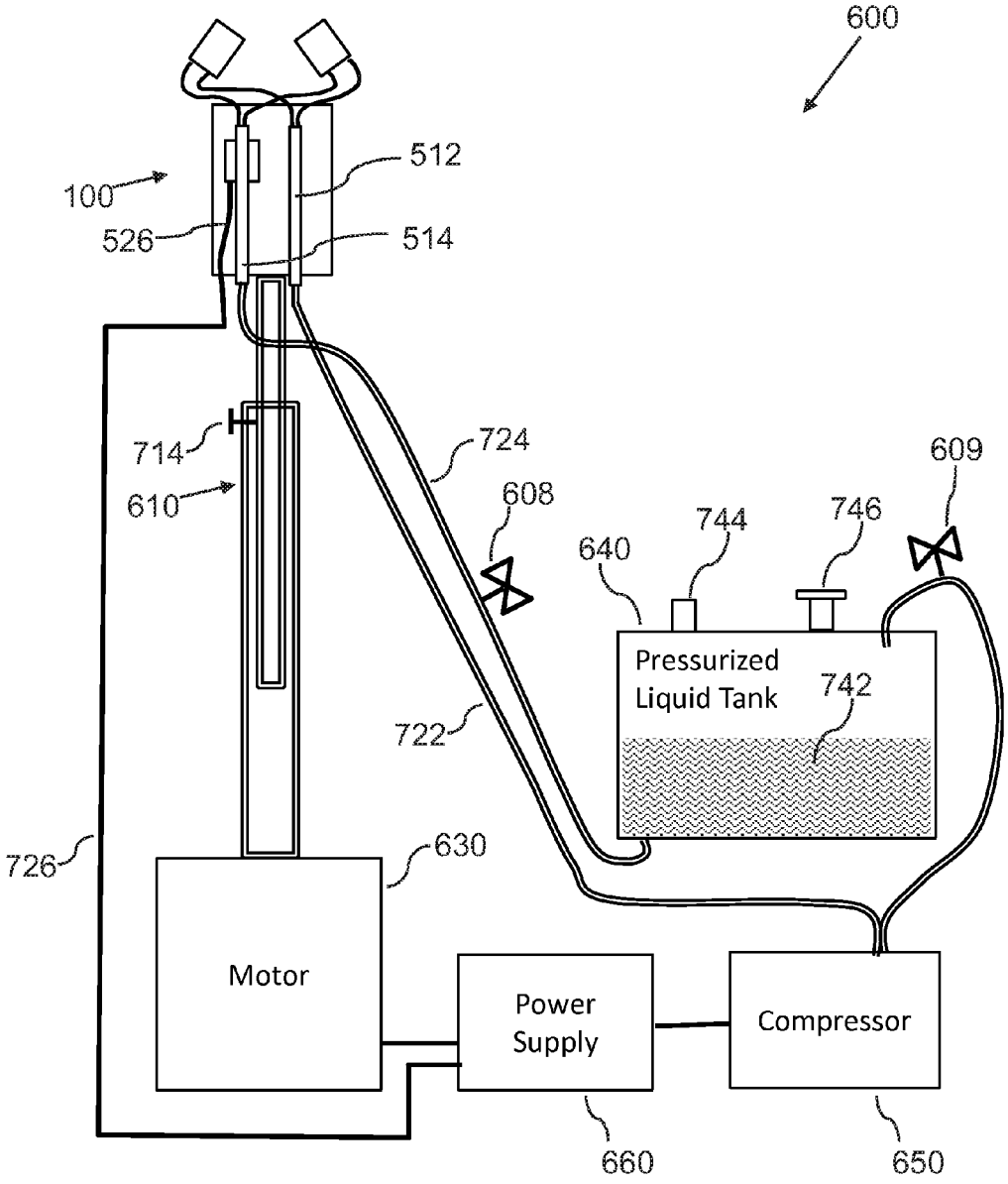
FIG. 7 is a schematic diagram of an adjustable atomizer nozzle system, according to an embodiment of the invention.

In an embodiment, FIG. 7 shows a schematic diagram of an adjustable atomizer nozzle system 600.

In an embodiment, as shown in FIGS. 6 and 7, an adjustable atomizer nozzle system 600 can include:

a. an adjustable atomizer nozzle assembly 100;

b. a mast assembly 610, which can be telescoping, as shown, such that the adjustable atomizer nozzle assembly 100 can be mounted on an upper end of the mast assembly 610, for example such that it is removably mounted in a cradle 612 that is connected to the upper end of the mast assembly 610;

c. a self-coiling line assembly 620, which can further include:

i. a compressed air line 722;

ii. a pressurized liquid line 724;

iii. a power line 726;

iv. wherein the line assembly 620 is connected to the nozzle assembly 100, such that the compressed air line 722 is connected to the internal compressed air tube 512; the pressurized liquid line 724 is connected to the internal liquid tube 514; and the power line 726 is connected to the electrical wire 526;

d. a motor 630, which is connected to the mast assembly 610 such that it can rotate the mast assembly 610;

e. a pressure tank 640, which can contain a pressurized liquid 742;

f. a compressor 650, which is connected to:

i. the pressure tank, such that the compressor pressurized the liquid 742; and ii. the compressed air line 722; such that the compressed air line 722 provides compressed air to the adjustable atomizer nozzle assembly 100;

g. a power supply 660, which is connected to the motor 630, the compressor 650, and the power line 726; and h. a mounting base 670, which as shown for example can be a mounting enclosure, or a platform, such that the mast assembly 610, motor 630, pressure tank 640, compressor 650, and power supply 660 are connected to the mounting base 670;

i. a plurality of wheels 680, which are connected to a bottom 672 of the mounting base 670, such that the wheels 680 can be casters 680, also sometimes referred to as roller wheels, whereby the adjustable atomizer nozzle system 600 can be conveniently moved around on a floor surface.

In a related embodiment, the mast assembly 610, in a telescoping configuration, can include a mast lock 714, to lock the mast assembly 610 at a predetermined extracted length. The lock can, as shown, be a lever type lock, or it can be a screw collar, or other well-known locking design for telescoping masts.

In a related embodiment, as shown in FIG. 6, the self-coiling line assembly 620 can be configured to coil around the mast assembly 610, for example for convenient use during fogging. In order to remove the adjustable atomizer nozzle assembly 100, for example for manual spray operation, the self-coiling line assembly 620 can be removed from the mast assembly 610.

In a related embodiment, the power supply 660 can be extended to an external power source, such as a building power circuit. The power supply 660 can be direct wiring from an external power source, or it can contain transformer components to adapt to specific power needs of components in the adjustable atomizer nozzle system 600, according to well-known methods and design principles for power supplies.

In a related embodiment, the adjustable atomizer nozzle system 600 can include:

a. A main switch 602 for deactivating or activating the compressor 650. This can also activate a ventilation fan;

b. A rotation switch 604 for deactivating or activating the motor 630. The motor 630 can be manually configured with a predetermined span of side-to-side rotation;

c. A heating switch 606 for deactivating or activating the liquid heater 540.

In a related embodiment, the pressure tank 640 can further include:

a. A manual pressure relief valve 746;

b. A pressure safety valve 744, for automatic pressure reduction when pressure is at a predetermined maximum pressure.

In a related embodiment, the adjustable atomizer nozzle system 600 can include a liquid flow gauge and control valve 608, to configure precision adjustment of liquid flow through the liquid line 724.

In a related embodiment, the adjustable atomizer nozzle system 600 can include a tank air valve 609, to enable or disable air pressure to the tank 640. Typically, the tank air valve 609 will be an on/off valve, but it can also be adjustable to control air flow to the tank.

In a related embodiment, external power can be supplied with a timer power outlet or extension cord. In a further related embodiment, the timer power outlet or extension cord can be remote controlled, for example via RF, Bluetooth, or WIFI.

In a related embodiment, the rotating telescopic mast assembly 610 can be configured to rotate up to 350 degrees at approximately 8 degree adjustable increments. This can further enhance dispersion and coverage of the disinfectant during automated fogging.

In a related embodiment, the adjustable atomizer nozzle system 600 can be configured to limit the maximum liquid flow in the system based on length and diameter of tubing and system air pressure.

In a further related example embodiment, the pressurized liquid line 724 can have a length of 23 feet and an internal diameter of 1/16", whereby if the compressor is delivering a pressure of 20 PSI, the liquid flow in the pressurized liquid line 724 can be limited to a maximum flow of approximately 100 ml/minute, which can be further reduced by adjustment of the control valve 608.

In a related embodiment, the adjustable atomizer nozzle system 600 can be configured with weight of less than 50 lbs. and with a size that permits shipping by express courier or as checked baggage.

In a related embodiment, the liquid 742 can be a hydrogen peroxide solution, in a concentration range of 1-12%.

In related embodiments, the adjustable atomizer nozzle system 600 can further include feedback control systems to control pressure and temperature, according to well-known methods, known to those with ordinary skill in the art of design of systems containing pressurized air and liquid.

In related embodiments, the first and second atomizer nozzles 126, 136 can use well known existing atomizer nozzle designs. This can include air atomizing nozzles made by Spraying Systems Co™, including models in model series 1/8J, 1/4J, 1/8JJ Compact Series, Variable Spray Series, 1/2J, 1J, and Special Purpose Series.

In related embodiments, the adjustable atomizer nozzle system 600 can be used for:

a. Fogging, wherein the system 600 is left activated in a central, wall or corner position of a room, such that the room is fogged;

b. Spraying, wherein the system 600 is used manually by an operator who removes the nozzle assembly from the mast assembly 610 and manually sprays selected parts of the room, and can move the system around as needed.

In various related embodiments and associated methods of use:

a. The intent of both fogging and spraying can be the same, to create a micro thin layer of disinfectant on all surfaces requiring decontamination. The surface being treated should look like a bathroom mirror after a hot shower. A light frosting is all that is needed on a pre-cleaned surface.

b. Spraying is a focused treatment. It allows the operator to selectively place the disinfectant in target areas and perform spot treatment for known contamination or difficult to reach areas.

c. Fogging allows the general treatment of an area. It is also more effective in knocking down airborne contamination. As the fogged disinfectant settles in the room most of the disinfectant settles to the floor. Over-fogging of a room will result in wet floors and horizontal surfaces. Wet floors require longer aeration times before the area can be entered without respiratory protection. Wetting also increases material compatibility issues. There is an art to fogging. That art is about finding the balance between under-fogging and over-fogging.

d. The adjustable atomizer nozzle system 600 enables the operator to combine the spray and the fog approach. A room can be first spot treated and then fogged for general treatment leaving a thicker layer of disinfectant on target items and areas. When using this technique the recommended fog dose times can be significantly reduced.

e. To optimize the creation of small aerosol droplets, the adjustable atomizer nozzle system 600 device can be precisely tuned for impingement as follows:

i. The tank valve 609 is used to pressurize the liquid tank and expel the two liquid streams through the nozzle;

ii. To pressurize the tank turn on the system with the tank valve 609 in the open position;

iii. Allow the system to come to operating pressure;

iv. Close the tank valve 609 and then turn off the main switch;

v. The retained pressure in the tank will force liquid to flow from each nozzle;

vi. The nozzles should be angled on an approximate 120° 240 and the streams should intersect to form a balanced cohesion impact lens;

vii. If the streams don't intersect, pivot the nozzle bodies as needed to achieve alignment;

viii. To relieve pressure from the tank open the ball valve and the air stream will shear the liquid streams into an aerosol or bleed off the pressure with the pressure relief valve.

f. When treating small areas by spray or by fog, the liquid flow can be reduced to as low as 10 ml/min (with heat off) using the control valve 608 and the air flow can also be reduced by bleeding off the pressure with the manual pressure relief valve 746. This will reduce the aerosol plume without significantly increasing droplet size and wetting of small areas or assets.

Figure 8:
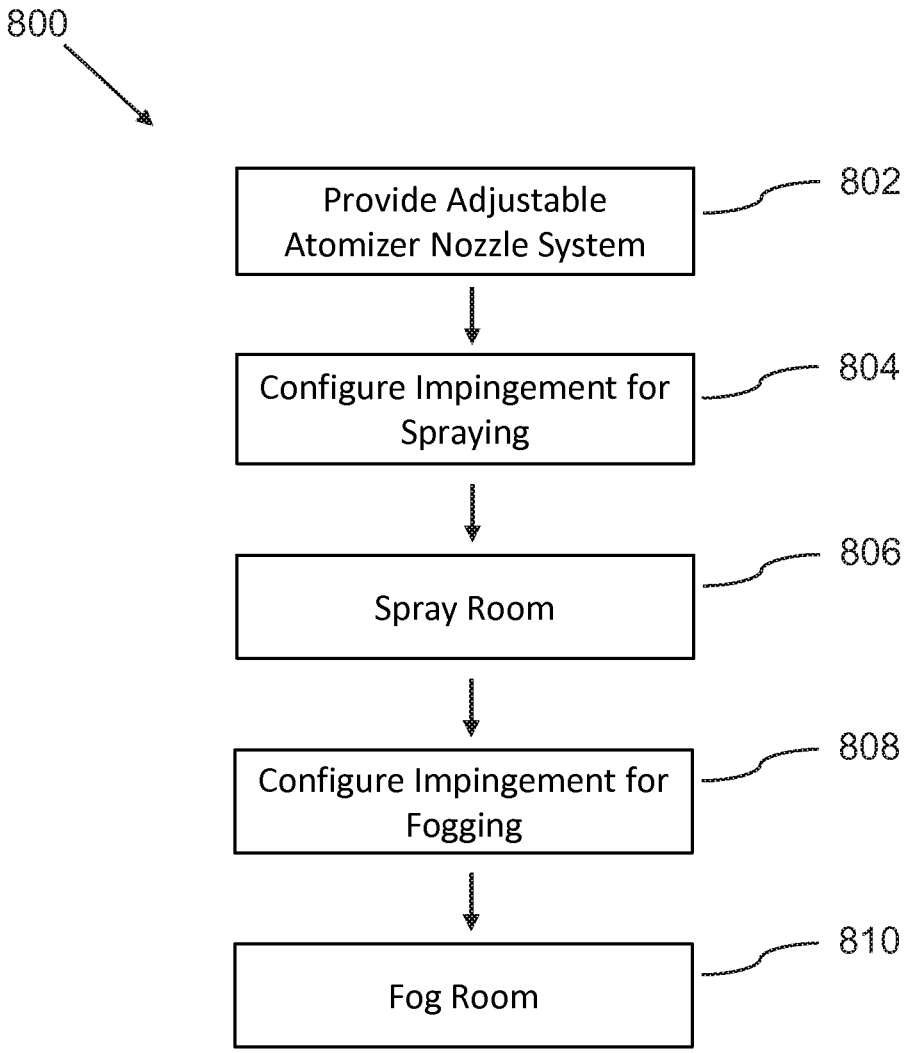
FIG. 8 is a flowchart illustrating steps that may be followed, in accordance with one embodiment of a method or process of using the adjustable atomizer nozzle system.

In an embodiment, as illustrated in FIG. 8, a method of using an adjustable atomizer nozzle system 800, can include:

a. Providing an adjustable atomizer nozzle system 802, wherein an operator moves an adjustable atomizer nozzle system 600 into a room in preparation for disinfecting the room, such that the adjustable atomizer can be placed in a central or corner location, or other suitable location in the room;

b. Configuring impingement for spraying 804, wherein an impingement angle of nozzles of the adjustable atomizer nozzle system 600 is configured for spraying;

c. Spraying the room 806, wherein predetermined locations of the room are sprayed with the adjustable atomizer nozzle system 600;

d. Configuring impingement for fogging 808, wherein an impingement angle of nozzles of the adjustable atomizer nozzle system 600 is configured for fogging;

e. Fogging the room 810, wherein the adjustable atomizer nozzle system 600 fogs the room for a predetermined length of time;

In an embodiment, two sets of first side nozzle component 120, 130 can be mounted such that one set is above the other set, whereby four atomizer nozzles can be configured with intersecting atomizer streams.

Figure 9:
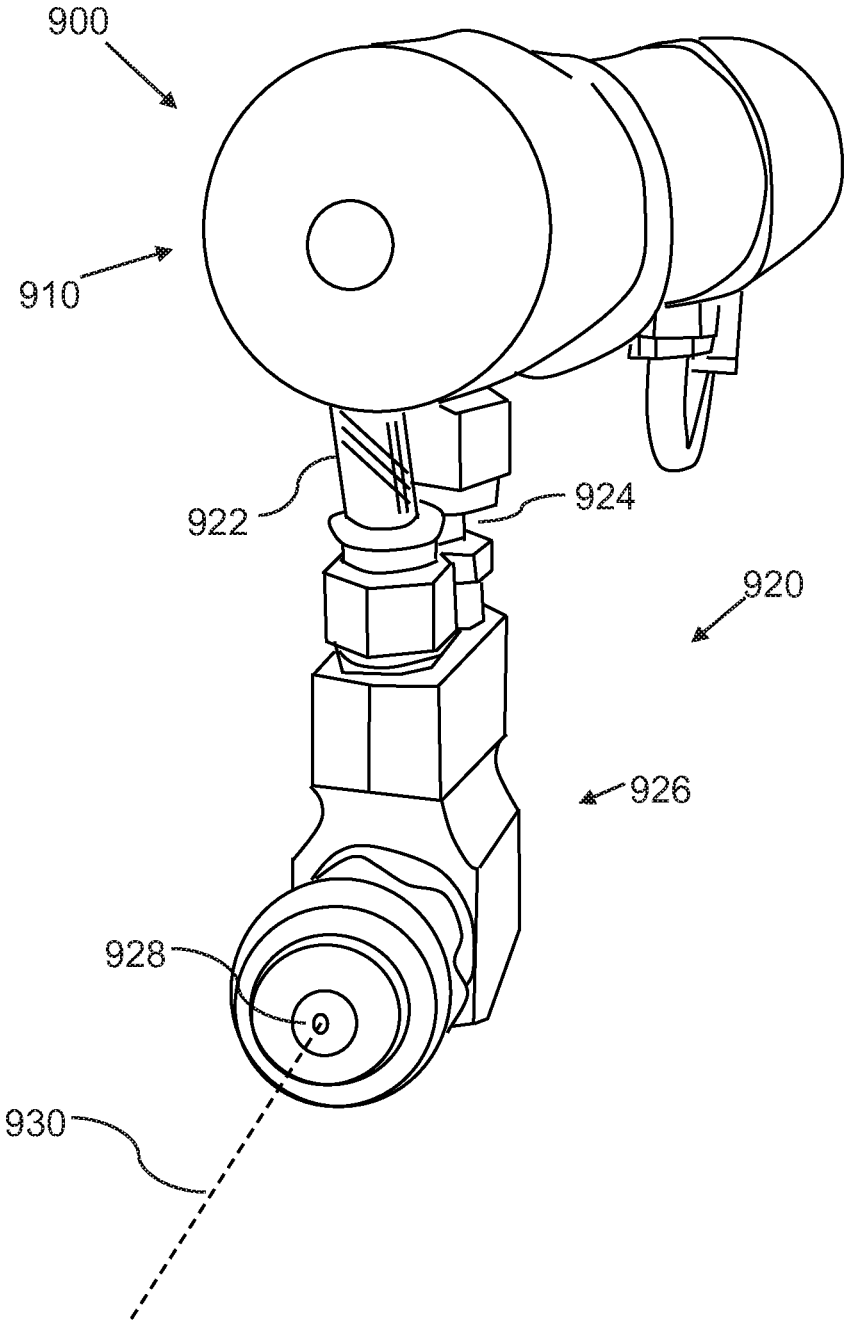
FIG. 9 is a perspective view of an adjustable atomizer nozzle assembly, according to an embodiment of the invention.

In an embodiment, as shown in FIG. 9, an adjustable atomizer nozzle assembly 900 can include:

a. An assembly body 910;

b. A first nozzle component 920, including:

i. A first compressed air tube 922;

ii. A first liquid tube 924;

iii. a liquid heater 540, which is mounted inside the assembly body 910;

iv. A first atomizer nozzle 926, which further comprises:

1. a first nozzle outlet 128;

wherein the first liquid tube 924 is connected in a first end to the assembly body 910, and is fixed or rotationally connected in a second end, via a first horizontal rotational connection 924, to a rear of the first atomizer nozzle 926, such that the first atomizer nozzle 926 is fixed in position or optionally can rotate in a rotational plane;

wherein the first compressed air tube 922 is flexibly connected between the assembly body 910 and the first atomizer nozzle 926; such that the flexible connection is enabled for example with the use of soft plastic tubing, in order to allow free rotation of the first horizontal rotational connection 924 between the first atomizer nozzle 926 and the first compressed air tube 922;

wherein the first compressed air tube 922 is in fluid connection with an internal compressed air tube 512, as shown in FIG. 5, inside the assembly body 910;

wherein the wherein the first liquid tube 924 is in fluid connection with an internal liquid tube 514, as shown in FIG. 5, inside the assembly body 110;

wherein the first atomizer nozzle 926 is configured to mix air in the first compressed air tube 922 with a liquid in the first liquid tube 924, such that the air and liquid is emitted by the nozzle outlet 928 in the form of a first aerosol stream in the direction of a first elongated axis 930, as shown in FIG. 2, from the nozzle outlet 928;

wherein the liquid heater 540 can be powered by an electrical wire 526;

wherein the liquid heater 540 is configured to heat the fluid in the internal liquid tube 514, before the fluid flows to the first atomizer nozzle 926;

whereby the heating can increase production of hydrogen peroxide vapor, cause increased penetration of porous surfaces, and enhance the dispersive qualities of the aerosol.

Here has thus been described a multitude of embodiments of the adjustable atomizer nozzle system 600, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An adjustable atomizer nozzle assembly, comprising:

a) an assembly body, which further comprises:

an internal liquid tube; and a liquid heater;

b) a first side nozzle component, comprising:

a first compressed air tube;

a first liquid tube; and a first atomizer nozzle, which further comprises a first nozzle outlet; and c) a second side nozzle component, comprising:

a second compressed air tube;

a second liquid tube; and a second atomizer nozzle, which further comprises a second nozzle outlet;

wherein the first liquid tube is connected in a first end to the assembly body, and is rotationally connected in a second end, via a first horizontal rotational connection, to a rear of the first atomizer nozzle, such that the first atomizer nozzle is configured to rotate in a horizontal plane;

wherein the first compressed air tube is flexibly connected between the assembly body and the first atomizer nozzle; in order to allow free rotation of the first horizontal rotational connection between the first atomizer nozzle and the first compressed air tube;

wherein the first atomizer nozzle is configured to mix air in the first compressed air tube with a liquid in the first liquid tube, such that the air and liquid is emitted by the nozzle outlet in the form of a first aerosol stream in the direction of a first elongated axis;

wherein the second liquid tube is connected in a first end to the assembly body, and is rotationally connected in a second end, via a second horizontal rotational connection, to a rear of the second atomizer nozzle, such that the second atomizer nozzle is configured to rotate in the horizontal plane;

wherein the second compressed air tube is flexibly connected between the assembly body and the second atomizer nozzle; in order to allow free rotation of the second horizontal rotational connection between the second atomizer nozzle and the second compressed air tube;

wherein the second atomizer nozzle is configured to mix air in the second compressed air tube with the liquid in the first liquid tube, such that the air and the liquid is emitted by the second nozzle outlet in the form of a second aerosol stream in the direction of a second elongated axis in the horizontal plane;

wherein the first and second aerosol streams intersect at an impingement angle between the first elongated axis and the second elongated axis;

wherein the impingement angle is configured to be adjustable by a configuration of a first rotational position of the first horizontal rotational connection and a configuration of a second rotational position of the second horizontal rotational connection;

wherein the first and second liquid tubes are in fluid connection with the internal liquid tube;

wherein the liquid heater is configured to heat the fluid in the internal liquid tube, before the fluid flows to the first and second atomizer nozzles;

whereby the first and second aerosol streams intersect and combine to form a combined aerosol stream, and whereby adjustment of the impingement angle adjusts the average droplet size and distribution of the combined aerosol stream.

2. The adjustable atomizer nozzle assembly of claim 1, wherein the impingement angle is configurable in a range of −90 degrees to 180 degrees.

3. The adjustable atomizer nozzle assembly of claim 1, wherein the impingement angle is configurable to be substantially zero degrees.

4. The adjustable atomizer nozzle assembly of claim 1, wherein the impingement angle is configurable to be substantially 135 degrees.

5. The adjustable atomizer nozzle assembly of claim 1, wherein the assembly body further comprises:

an internal compressed air tube;

wherein the first and second compressed air tubes are in fluid connection with the internal compressed air tube.

6. The adjustable atomizer nozzle assembly of claim 5, wherein the assembly body further comprises:

an air heater;

wherein the air heater is configured to heat the air in the internal compressed air tube.

7. An adjustable atomizer nozzle assembly, comprising:

a) an assembly body, which further comprises:
an internal compressed air tube; and
an air heater;

b) a first side nozzle component, comprising:
a first compressed air tube;
a first liquid tube; and
a first atomizer nozzle, which further comprises a first nozzle outlet; and c) a second side nozzle component, comprising:
a second compressed air tube;
a second liquid tube; and
a second atomizer nozzle, which further comprises a second nozzle outlet;

wherein the first liquid tube is connected in a first end to the assembly body, and is rotationally connected in a second end, via a first horizontal rotational connection, to a rear of the first atomizer nozzle, such that the first atomizer nozzle is configured to rotate in a horizontal plane;

wherein the first compressed air tube is flexibly connected between the assembly body and the first atomizer nozzle; in order to allow free rotation of the first horizontal rotational connection between the first atomizer nozzle and the first compressed air tube;

wherein the first atomizer nozzle is configured to mix air in the first compressed air tube with a liquid in the first liquid tube, such that the air and liquid is emitted by the nozzle outlet in the form of a first aerosol stream in the direction of a first elongated axis;

wherein the second liquid tube is connected in a first end to the assembly body, and is rotationally connected in a second end, via a second horizontal rotational connection, to a rear of the second atomizer nozzle, such that the second atomizer nozzle is configured to rotate in the horizontal plane;

wherein the second compressed air tube is flexibly connected between the assembly body and the second atomizer nozzle; in order to allow free rotation of the second horizontal rotational connection between the second atomizer nozzle and the second compressed air tube;

wherein the second atomizer nozzle is configured to mix air in the second compressed air tube with the liquid in the first liquid tube, such that the air and the liquid is emitted by the second nozzle outlet in the form of a second aerosol stream in the direction of a second elongated axis in the horizontal plane;

wherein the first and second aerosol streams intersect at an impingement angle between the first elongated axis and the second elongated axis;

wherein the impingement angle is configured to be adjustable by a configuration of a first rotational position of the first horizontal rotational connection and a configuration of a second rotational position of the second horizontal rotational connection;

wherein the first and second compressed air tubes are in fluid connection with the internal compressed air tube;

wherein the air heater is configured to heat the air in the internal compressed air tube, before the air flows to the first and second atomizer nozzles;

whereby the first and second aerosol streams intersect and combine to form a combined aerosol stream, and whereby adjustment of the impingement angle adjusts the average droplet size and distribution of the combined aerosol stream.

8. The adjustable atomizer nozzle assembly of claim 1, wherein the impingement angle is configurable in a range of −90 degrees to 180 degrees.

9. The adjustable atomizer nozzle assembly of claim 7, wherein the impingement angle is configurable to be substantially zero degrees.

10. The adjustable atomizer nozzle assembly of claim 7, wherein the impingement angle is configurable to be substantially 135 degrees.

11. The adjustable atomizer nozzle assembly of claim 7, wherein the assembly body further comprises:

an internal liquid tube;

wherein the first and second liquid tubes are in fluid connection with the internal liquid tube.

12. The adjustable atomizer nozzle assembly of claim 11, wherein the assembly body further comprises:

a liquid heater;

wherein the liquid heater is configured to heat the fluid in the internal liquid tube.

* * * * *